US008890753B1

(12) United States Patent
Lee

(10) Patent No.: US 8,890,753 B1
(45) Date of Patent: Nov. 18, 2014

(54) ANTENNA STRUCTURE WITH SPLIT-FEED ANTENNA ELEMENT AND COUPLED PARASITIC GROUNDING ELEMENT

(71) Applicant: Amazon Technologies, Inc., Reno, NV (US)

(72) Inventor: Tzung-I Lee, San Jose, CA (US)

(73) Assignee: Amazon Technologies, Inc., Reno, NV (US)

( * ) Notice: Subject to any disclaimer, the term of this patent is extended or adjusted under 35 U.S.C. 154(b) by 171 days.

(21) Appl. No.: 13/626,403

(22) Filed: Sep. 25, 2012

(51) Int. Cl.
*H01Q 1/24* (2006.01)
*H01Q 1/48* (2006.01)

(52) U.S. Cl.
CPC . *H01Q 1/48* (2013.01); *H01Q 1/243* (2013.01)
USPC ..... 343/702; 343/846; 343/848

(58) Field of Classification Search
CPC ..... H01Q 1/243; H01Q 1/48; H01Q 5/0027
USPC ..... 343/702, 846, 848
See application file for complete search history.

(56) References Cited

U.S. PATENT DOCUMENTS

| | | | | |
|---|---|---|---|---|
| 6,985,114 | B2 | 1/2006 | Egashira | |
| 7,050,010 | B2 | 5/2006 | Wang et al. | |
| 7,136,019 | B2 * | 11/2006 | Mikkola et al. | 343/702 |
| 7,602,341 | B2 | 10/2009 | Wei-Shen et al. | |
| 7,705,784 | B2 | 4/2010 | Lai et al. | |

OTHER PUBLICATIONS

USPTO Notice of Allowance for U.S. Appl. No. 13/626,404 mailed Jun. 12, 2014.

* cited by examiner

*Primary Examiner* — Hoang V Nguyen
(74) *Attorney, Agent, or Firm* — Lowenstein Sandler LLP

(57) ABSTRACT

Antenna structures of electronic devices and methods of operating the electronic devices with the antenna structures are described. One apparatus includes a RF feed coupled to a split-feed antenna element of an antenna structure. The antenna structure also includes a parasitic grounding element coupled to a ground plane. The split-feed antenna element is configured to operate as a feeding structure to the parasitic grounding element that is not conductively connected to the RF feed.

21 Claims, 9 Drawing Sheets

ANTENNA STRUCTURE WITH SPLIT-FEED ANTENNA ELEMENT AND COUPLED PARASITIC GROUNDING ELEMENT

BACKGROUND

This application is related to co-pending application U.S. application Ser. No. 13/626,404, filed Sep. 25, 2012, and the entire contents of which are incorporated herein by reference.

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops and the like. These electronic devices wirelessly communicate with a communications infrastructure to enable the consumption of the digital media items. In order to wirelessly communicate with other devices, these electronic devices include one or more antennas.

The conventional antenna usually has only one resonant mode in the lower frequency band and one resonant mode in the high band. One resonant mode in the lower frequency band and one resonant mode in the high band may be sufficient to cover the required frequency band in some scenarios, such as in 3G applications. 3G, or 3rd generation mobile telecommunication, is a generation of standards for mobile phones and mobile telecommunication services fulfilling the International Mobile Telecommunications-2000 (IMT-2000) specifications by the International Telecommunication Union. Application services include wide-area wireless voice telephone, mobile Internet access, video calls and mobile TV, all in a mobile environment. The required frequency bands for 3G applications may be GSM850/EGSM in low band and DCS/PCS/WCDMA in high band. The 3G band is between 824 MHz and 960 MHz. Long Term Evolution (LTE) and LTE Advanced (sometimes generally referred to as 4G) are communication standards that have been standardized by the 3rd Generation Partnership Project (3GPP). However, in order to extend the frequency coverage down to 700 MHz for 4G/LTE application, antenna bandwidth needs to be increased especially in the low band. There are two common LTE bands used in the United States from 704 MHz-746 MHz (Band 17) and from 746 MHz-787 MHz (Band 13). Conventional solutions increase the antenna size or use active tuning elements to extend the bandwidth. Alternatively, conventional solutions use separate antennas to achieve different frequency bands and use a switch to switch between the antennas. These solutions are not conducive to use in user devices, often because of the size of the available space for antennas within the device.

BRIEF DESCRIPTION OF THE DRAWINGS

The present invention will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1:
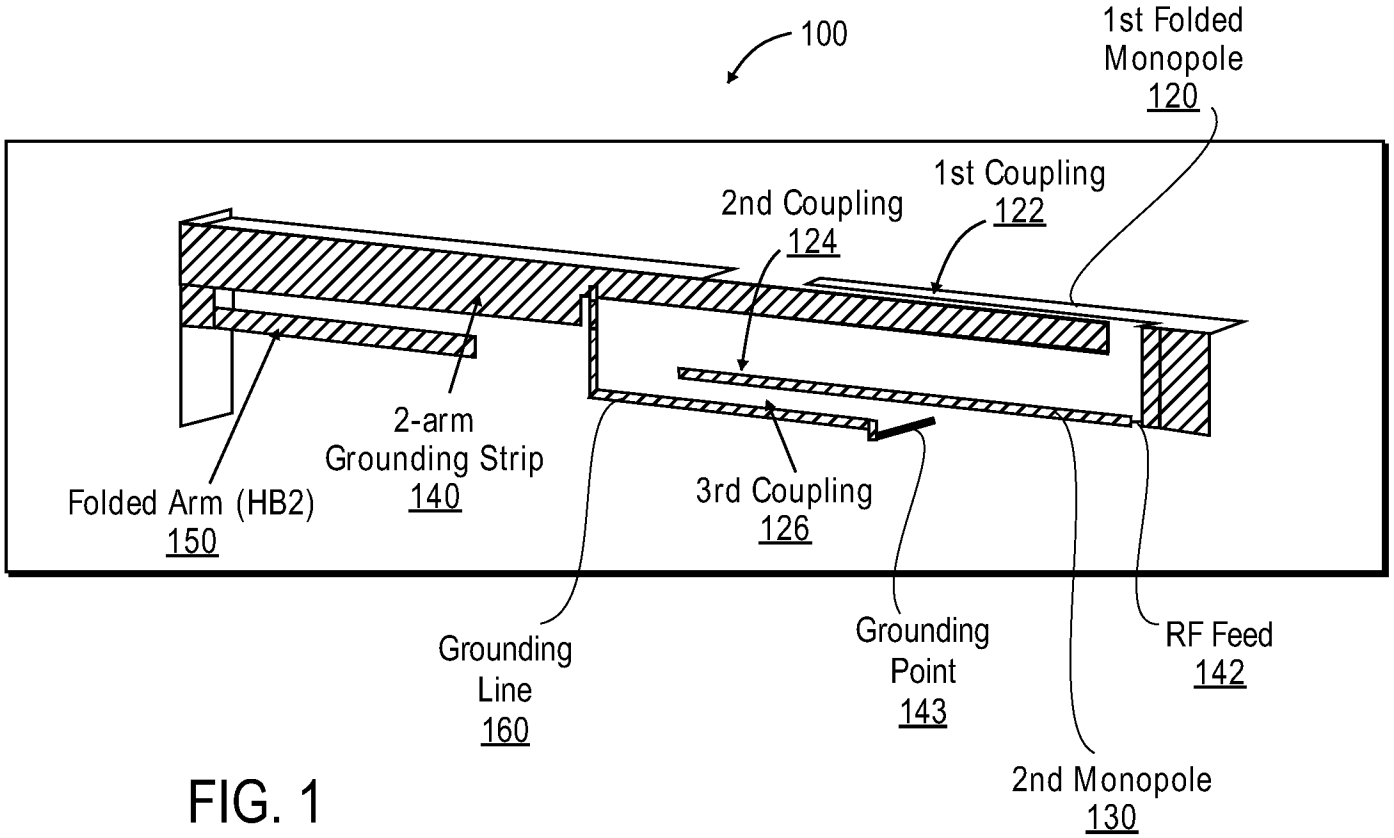
FIG. 1 illustrates one embodiment of an antenna structure including a two-arm grounding strip interleaved with antenna elements coupled to a radio frequency (RF) feed.

Antenna structures of user devices and methods of operating the user devices with the antenna structures are described. One apparatus includes a RF feed coupled to a first element and a second element of an antenna structure. The antenna structure also includes a parasitic grounding element coupled to a ground plane and is interleaved with the first element and second element to form at least a dual coupling with respect to the RF feed. The first element and second element are configured to operate as a feeding structure to a parasitic grounding element that is not conductively connected to the RF feed. The antenna structure has an RF feed that drives the first element and the second element as active or driven elements and the parasitic grounding element is a parasitic element that is fed by the first and second elements. By parasitically coupling the first and second elements with the parasitic grounding element, multiple resonant modes can be created in the low band and in the high band.

Another apparatus includes a RF feed coupled to a split-feed antenna element of an antenna structure. The antenna structure also includes a parasitic grounding element coupled to a ground plane. The split-feed antenna element is configured to operate as a feeding structure to the parasitic grounding element that is not conductively connected to the RF feed. The split-feed antenna element is a feeding structure because it is the element that parasitically induces current on the parasitic grounding element, since it is not conductively connected to the RF feed.

The user device may be any content rendering device that includes a wireless modem for connecting the user device to a network. Examples of such user devices include electronic book readers, portable digital assistants, mobile phones, laptop computers, portable media players, tablet computers, cameras, video cameras, netbooks, notebooks, desktop computers, gaming consoles, DVD players, media centers, and the like. The user device may connect to a network to obtain content from a server computing system (e.g., an item providing system) or to perform other activities. The user device may connect to one or more different types of cellular networks.

As described above, the conventional antenna usually has only one resonant mode in the lower frequency band and one resonant mode in the high band. The embodiments described herein extend the bandwidth by using the antenna structures described herein. In one embodiment, one of the antenna structures is configured to operate between 700 MHz and 960 MHz in a low band and between 1.71 and 2.7 GHz in a high band. In one embodiment, another one of the antenna structures is configured to operate between 700 MHz and 960 MHz in a low band and between 1.71 and 2.17 GHz in a high band. In other embodiments, the antenna structure is configured to operating in one or more of the following frequency bands Long Term Evolution (LTE) 700, LTE 2700, Universal Mobile Telecommunications System (UMTS) and Global System for Mobile Communications (GSM) 850, GSM 900, GSM 1800 and GSM 1900. The antenna structure may provide multiple resonant modes, for example, a first low-band mode, a second low-band mode, a first high-band mode, and a second high-band mode.

The embodiments described herein are not limited to use in 3G and LTE bands, but could be used to increase the bandwidth of a multi-band frequency in other bands, such as Dual-band Wi-Fi, GPS, cellular, and Bluetooth frequency bands as described herein. The embodiments described herein provide an antenna structure to be coupled to a single RF feed and does not use any active tuning to achieve the extended bandwidths. The embodiments described herein also provide an antenna structure with a size that is conducive to being used in a user device.

FIG. 1 illustrates one embodiment of an antenna structure 100 including a two-arm grounding strip 140 interleaved with antenna elements 120, 130 coupled to a radio frequency (RF) feed 142. In this embodiment, the antenna structure 100 is fed at the RF feed 142, which is coupled to a first folded monopole element 120 and a second monopole element 130. The two-arm grounding strip 140 is a parasitic grounding element. A parasitic element is an element of the antenna structure 100 that is not driven directly by the single RF feed 142. Rather, the single RF feed 142 directly drives the antenna elements 120, 130 of the antenna structure, which parasitically induces a current on the parasitic element. In particular, by directly inducing current on the first folded monopole element 120 and the second monopole element 130 by the single RF feed 142, the directly-fed structures radiates electromagnetic energy, which causes another current on the two-arm grounding strip 140 to also radiate electromagnetic energy, creating multiple resonant modes. In the depicted embodiment, the two-arm grounding strip 140 is parasitic because it is physically separated from the first folded monopole element 120 that is driven at the single RF feed 142. It can also be said that the parasitic element 130 is not conductively connected to the RF feed 142. The driven first folded monopole element 120 and driven second monopole element 130 parasitically excite the current flow of the two-arm grounding strip 140. In one embodiment, the two-arm grounding strip 140 can be physically separated by a gap between the first folded monopole element 120 and the second monopole element 130. Alternatively, other antenna configurations may be used to include driven antenna elements and a parasitic grounding element.

In the depicted embodiment, the antenna structure 100 also includes a meandering ground line 160 that couples the two-arm ground strip 140 to the ground plane at a grounding point 143. The meandering ground line 160 and a first arm of the two-arm grounding strip 140 are interleaved with the first folded monopole element 120 and the second monopole element 130. Three parts in this antenna structure 100 provide strong coupling. The first folded monopole element 120 is disposed in relation to the first arm of the two-arm grounding strip 140 to form a first coupling of the antenna structure 100. The second monopole element 130 is disposed in relation to the first arm of the two-arm grounding strip 140 to form a second coupling of the antenna structure 100. The second monopole element 130 is also disposed in relation to the meandering ground line 160 to form a third coupling of the antenna structure 100. Each coupling has a different effect on all resonance modes of the antenna structure 100, such as a first low-band (LB1) mode, a second low-band (LB2) mode, a first high-band (HB1) mode, and a second high-band (HB2) mode. With this triple-coupling tuning factor, it provides even more tuning dimensions for the resonance excitation other than the tuning the length of different arms only. Also, the strong coupling may allow the antenna structure 100 to be a very slim design, such as between 3 and 5 mm in height and between 3 and 5 mm in width. Also, the antenna structure 100 allows for total coverage by the ground plane underneath the antenna structure 100 with some distance between the ground plane and the two-arm grounding strip 140. It should be noted that in other embodiments, the antenna structure 100 can be configured to have a dual coupling with respect to the RF feed.

In a further embodiment, the antenna structure 100 also includes a folded arm 150 coupled to a distal end of a second arm of the two-arm grounding strip 140. The distal end is the end that is farthest from the RF feed.

In FIG. 1, the ground may be a radiation ground plane (not illustrated in FIG. 1). The RF feed 142 may be a feed line connector that couples the antenna structure 100 to a feed line (also referred to as the transmission line), which is a physical connection that carriers the RF signal to and/or from the antenna structure 100. The feed line connector may be any one of the three common types of feed lines, including coaxial feed lines, twin-lead lines or waveguides. A waveguide, in particular, is a hollow metallic conductor with a circular or square cross-section, in which the RF signal travels along the inside of the hollow metallic conductor. Alternatively, other types of connectors can be used. In the depicted embodiment, the feed line connector is directly connected to first folded monopole element 120 and the second monopole element 130 of the antenna structure 100, but is not conductively connected to the two-arm grounding strip 140 of the antenna structure 100. However, the first folded monopole element 120 and the second monopole element 130 is configured to operate as a feeding structure to the two-arm grounding strip 140.

In one embodiment, the antenna structure 100 is disposed on an antenna carrier, such as described below with respect to FIG. 2. In another embodiment, portions of the antenna structure 100 may be disposed on or within a circuit board, such as a printed circuit board (PCB). Alternatively, the antenna structure 100 may be disposed on other components of the user device or within the user device as would be appreciated by one of ordinary skill in the art having the benefit of this disclosure. It should be noted that the antenna structure 100 illustrated in FIG. 1 is a three-dimensional (3D) structure. However, as described herein, the antenna structure 100 may be a planar, two-dimensional (2D), as well as other variations than those depicted in FIG. 1. In one embodiment, the two-arm grounding strip 140, the first folded monopole element 120, the second monopole element 130, or any combination thereof can be partially disposed on two or more sides of the antenna carrier. For example, the two-arm grounding strip 140 can be disposed on the front surface and the top surface of the antenna carrier. The first folded monopole element 120 can be disposed on the front surface and the top surface of the antenna carrier. The second folded monopole element 130 can be disposed on the front surface of the antenna carrier.

Similarly, portions of these elements can be disposed on sides of the antenna carrier as would be appreciated by one of ordinary skill in the art having the benefit of this disclosure.

The antenna structure 100 is configured to provide multiple resonant modes, including a LB1, LB2, HB1 and HB2. In the depicted embodiment, the antenna structure 100 is configured to operate between 700 MHz and 960 MHz in a low band and between 1.71 and 2.7 GHz in a high band. This allows the antenna structure 100 to operate in one or more of the following frequency bands: LTE 700, LTE 2700, UMTS, GSM 850, GSM 900, GSM 1800 and GSM 1900. In a further embodiment, the antenna structure 100 is configured to operate in additional frequency bands, such as Global Positioning System (GPS), wireless local area network (WLAN) (e.g., WiFi), personal area network (PAN), or any combination thereof. Using the first folded monopole element 120, the second monopole element 130, and the two-arm grounding strip 140, the antenna structure 100 can create multiple resonant modes using the single RF feed 142, such as three or more resonant modes. In one embodiment, the first folded monopole element 120, second monopole element 130, and two-arm grounding strip 140 are configured to extend a bandwidth of the antenna structure 100. In one embodiment, the antenna structure 100 has multiple resonant modes with frequencies between 700 MHz and 2.7 GHz. In one embodiment, the first folded monopole element 120 and the second monopole element 130 are configured to provide a first resonant mode, centered at 700 MHz, second resonate mode, centered at 900 MHz and third mode, centered at 2200 MHz. Whilst, the two-arm grounding strip 140 is configured to provide a fourth resonant mode, centered at 1.5 GHz. In another embodiment, the antenna structure 100 can be configured to create a resonant mode for LTE 700 plus resonant modes for penta-band. In telecommunications, the terms multi-band, dual-band, tri-band, quad-band, and penta-band refer to a device, such as the user device described herein, supporting multiple RF bands used for communication. In other embodiments, the antennas can be designed to cover multiple bands, including LTE/GSM/UMTS, the GSM850/900/1800/1900/UMTS penta-band operation, or the LTE700/GSM850/900 (698-960 MHz) and GSM 1800/190/UMTS/LTE2300/2500 (1710-2690) MHz operation. In the user device context, the purpose of doing so is to support roaming between different regions whose infrastructure cannot support mobile services in the same frequency range. These frequency bands may be UMTS frequency bands, GSM frequency bands, or other frequency bands used in different communication technologies, such as, for example, cellular digital packet data (CDPD), general packet radio service (GPRS), enhanced data rates for GSM evolution (EDGE), 1 times radio transmission technology (1xRTT), evaluation data optimized (EVDO), high-speed downlink packet access (HSDPA), WiFi, WiMax, etc.

The dimensions of the antenna structure 100 may be varied to achieve the desired frequency range as would be appreciated by one of ordinary skill in the art having the benefit of this disclosure, however, the total lengths of the antenna elements are a major factor for determining the frequency, and the widths of the antenna elements are a factor for impedance matching. It should be noted that the factors of total length and width are dependent on one another.

In the depicted embodiment, the first folded monopole element 120 includes a first portion that is coupled to the RF feed 142 at a bottom side of the antenna carrier and extends away from the RF feed 142, and wraps around a front side of the antenna carrier onto a top side of the antenna carrier. The first folded monopole element 120 includes a second portion that extends along the top side of thee antenna carrier. The first portion and the second portion form a folded monopole element. In a further embodiment, the second monopole element 130 extends along the front side of the antenna carrier in a same direction as the second portion.

In a further embodiment, the two-arm grounding strip 140 includes a first arm that extends from where the meandering ground line 160 couples to the two-arm grounding strip 140 along the front side of the antenna carrier towards the RF feed 142. The first arm is interleaved with the first portion of the first folded monopole element 120 and the second monopole element 130. The two-arm grounding strip 140 includes a second arm that extends away from the where the meandering ground line 160 couples to the two-arm grounding strip 140 and wraps around at least the front side and the top side of the antenna carrier. In the depicted embodiment, the two-arm grounding strip 140 also includes a folded arm coupled to a distal end of the second arm that extends towards a bottom of the front side of the antenna carrier, and turns to extend along the front side of the antenna carrier towards the meandering ground line 160. The two-arm grounding strip 140 also includes a portion that is disposed on a side that extends below the folded arm 150 on the left side.

In another embodiment, the first folded monopole element 120 includes a first line having a path with one or more bends, and the second monopole element 130 includes a second line without any bends. In other embodiments, the antenna elements 120 and 130 may be folded monopoles, monopoles, or any combination thereof. In one embodiment, the first folded monopole element 120, second monopole element 130, and the two-arm grounding strip 140 are coplanar.

In another embodiment, the antenna structure includes a first element and a second element, each coupled to the RF feed 142. A parasitic grounding element is coupled to the ground plane and is disposed to interleave with the first element and the second element to form at least a dual coupling with respect to the RF feed. In another embodiment, the parasitic grounding element is coupled to a meandering ground line to form a third coupling with respect to the RF feed. The parasitic grounding element may be the two-arm grounding strip 140, but may also be other types of structures that includes section that interleave or otherwise create a coupling between the first elements and second element and the parasitic grounding element. The first element may be the first folded monopole element 120 or may have other shapes and dimensions as would be appreciated by one of ordinary skill in the art having the benefit of this disclosure. The second element may be the second monopole element 130 or may have other shapes and dimensions as would be appreciated by one of ordinary skill in the art having the benefit of this disclosure.

Figure 2:
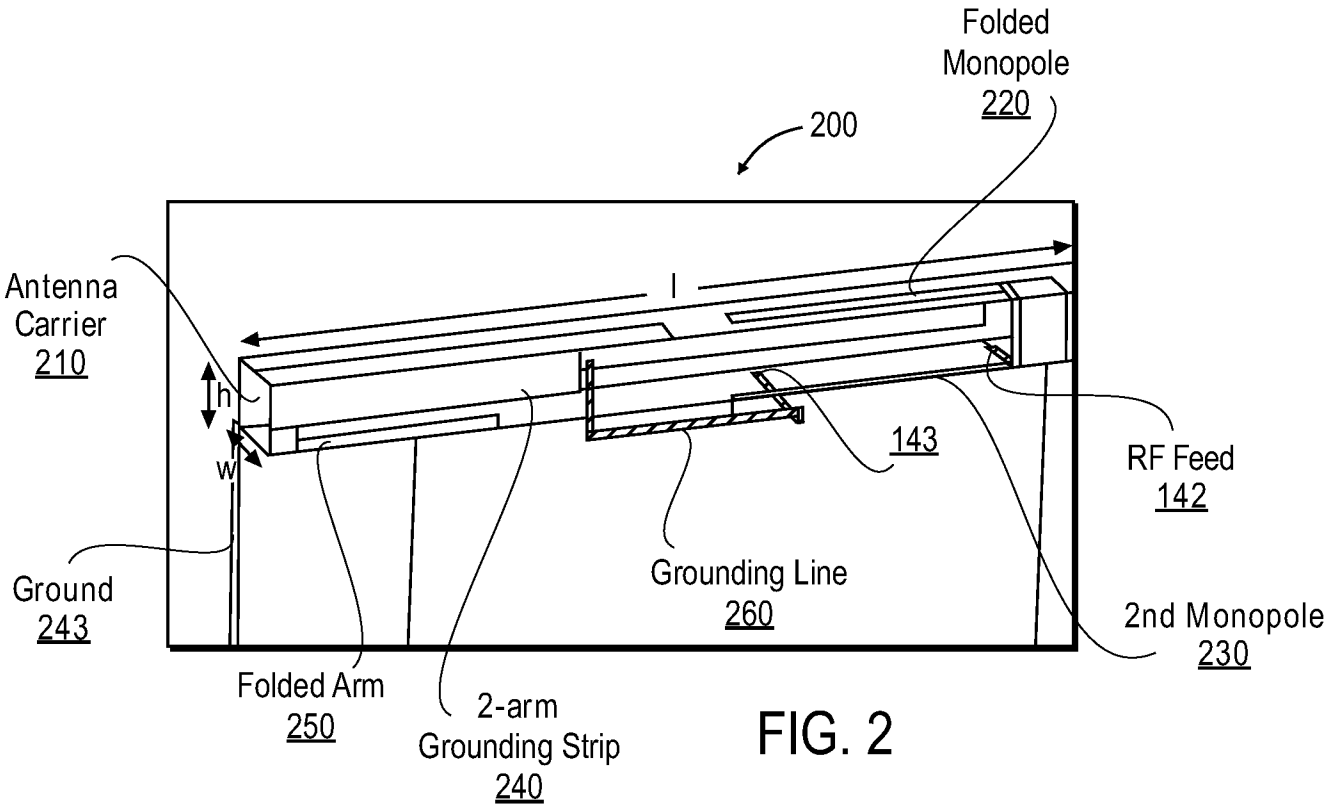
FIG. 2 illustrates another embodiment of an antenna structure including a two-arm grounding strip interleaved with antenna elements coupled to a RF feed.

FIG. 2 illustrates another embodiment of an antenna structure 200 including a two-arm grounding strip 240 interleaved with antenna elements 220, 230 coupled to a RF feed 142. In this embodiment, the antenna structure 200 is fed at the RF feed 142, which is coupled to a first folded monopole element 220 and a second monopole element 230. The first folded monopole element 220 is similar to the first folded monopole element 120 and the second monopole element 230 is similar to the second monopole element 130. A two-arm grounding strip 240 is a parasitic grounding element similar to the two-arm grounding strip 140 except as noted below. The antenna structure 200 also includes a meandering ground line 260 similar to the meandering ground line 160 that couples the two-arm ground strip 240 to the ground plane at a grounding point 143. The meandering ground line 260 and a first arm of the two-arm grounding strip 240 are interleaved with the first folded monopole element 220 and the second monopole element 230. The antenna structure 200 also includes a folded arm 250 coupled to a distal end of a second arm of the two-arm grounding strip 240.

Like the antenna structure 100, three parts in this antenna structure 200 provide strong coupling. The coupling allows for tuning, as well as impedance matching. Each coupling has a different effect on all resonance modes of the antenna structure 200, such as a first low-band (LB1) mode, a second low-band (LB2) mode, a first high-band (HB1) mode, and a second high-band (HB2) mode. With this triple-coupling tuning factor, it provides even more tuning dimensions for the resonance excitation other than the tuning the length of different arms only. Also, the strong coupling may allow the antenna structure 200 to be a very slim design, such as between 3 and 5 mm in height and between 3 and 5 mm in width. Also, the antenna structure 200 allows for total coverage by the ground plane underneath the antenna structure. It should be noted that in other embodiments, the antenna structure 200 can be configured to have a dual coupling with respect to the RF feed, instead of triple coupling as depicted.

In FIG. 2, the ground is a radiation ground plane 243. The ground plane 243 may be a metal frame of the user device. The ground plane 243 may be a system ground or one of multiple grounds of the user device. In the depicted embodiment, the antenna structure 200 is disposed on an antenna carrier 210, such as a dielectric carrier of the user device. The antenna carrier 210 may be any non-conductive material, such as dielectric material, upon which the conductive material of the antenna structure 200 can be disposed without making electrical contact with other metal of the user device. In another embodiment, portions of the antenna structure 200 may be disposed on or within a circuit board, such as a PCB. Alternatively, the antenna structure 200 may be disposed on other components of the user device or within the user device as would be appreciated by one of ordinary skill in the art having the benefit of this disclosure. It should be noted that the antenna structure 200 illustrated in FIG. 2 is a three-dimensional (3D) structure, but may be 2D as well. The two-arm grounding strip 240, the first folded monopole element 220, the second monopole element 230, or any combination thereof can be partially disposed on two or more sides of the antenna carrier 210. For example, the two-arm grounding strip 240 can be disposed on the front surface and the top surface of the antenna carrier 210. The first folded monopole element 220 can be disposed on the front surface and the top surface of the antenna carrier. The second folded monopole element 230 can be disposed on the front surface of the antenna carrier. Similarly, portions of these elements can be disposed on sides of the antenna carrier as would be appreciated by one of ordinary skill in the art having the benefit of this disclosure.

The antenna structure 200 is configured to provide multiple resonant modes and operate in similar frequency bands as the antenna structure 100.

In one embodiment, a height of the antenna structure 200 is between 3 millimeters (mm) and 5 mm and a width of the antenna structure 200 is between 3 and 5 mm. In a further embodiment, a length of the antenna structure 200 is between 30 mm and 60 mm. The dimensions of the antenna structure 200 may be varied to achieve the desired frequency range as would be appreciated by one of ordinary skill in the art having the benefit of this disclosure.

In the depicted embodiment, the first folded monopole element 220 includes a first portion that is coupled to the RF feed 142 at a bottom side of the antenna carrier 210 and extends away from the RF feed 142, and wraps around a front side of the antenna carrier 210 onto a top side of the antenna carrier 210. The first folded monopole element 220 includes a second portion that extends along the top side of thee antenna carrier 210. The first portion and the second portion form a folded monopole element. In a further embodiment, the second monopole element 230 extends along the front side of the antenna carrier 210 in a same direction as the second portion.

In a further embodiment, the two-arm grounding strip 240 includes a first arm that extends from where the meandering ground line 260 couples to the two-arm grounding strip 240 along the front side of the antenna carrier 210 towards the RF feed 142. The first arm is interleaved with the first portion of the first folded monopole element 220 and the second monopole element 230. The two-arm grounding strip 240 includes a second arm that extends away from the where the meandering ground line 260 couples to the two-arm grounding strip 240 and wraps around at least the front side and the top side of the antenna carrier 210. In the depicted embodiment, the two-arm grounding strip 240 also includes a folded arm 250 coupled to a distal end of the second arm that extends towards a bottom of the front side of the antenna carrier 210, and folds to extend along the front side of the antenna carrier 210 towards the meandering ground line 260. Unlike the two-arm grounding strip 140, the two-arm grounding strip 240 does not have a portion on the left side of the antenna carrier 210. In one embodiment, the ground plane 243 can be disposed where the antenna carrier 210 is disposed just above the ground plane 243. In another embodiment, the ground plane 243 can be disposed so that the antenna carrier 210 is covered by the ground plane 243 on the backside.

Figure 3:
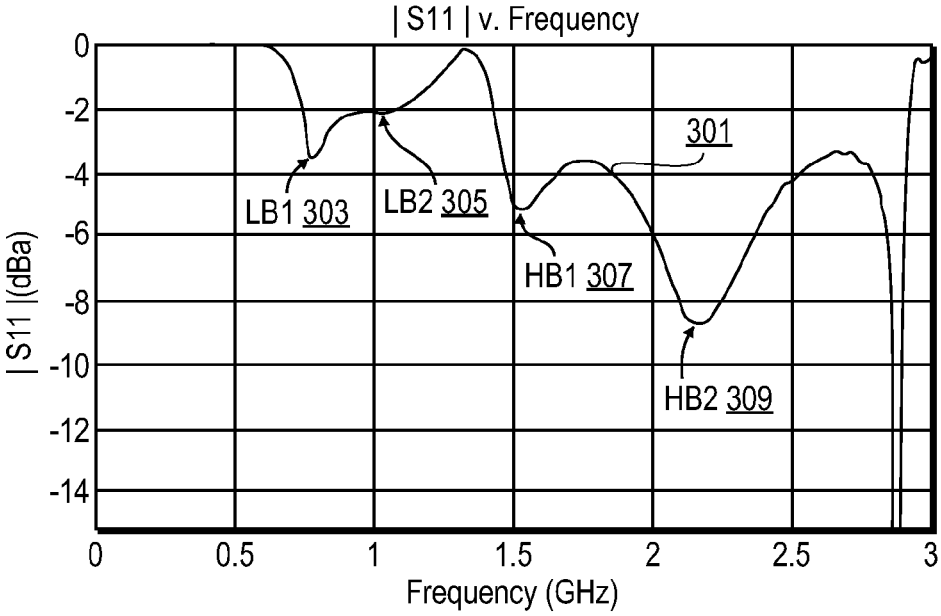
FIG. 3 is a graph of measured reflection coefficient of the antenna structure of FIG. 1 according to one embodiment.

FIG. 3 is a graph 300 of measured reflection coefficient of the antenna structure 100 of FIG. 1 according to one embodiment. The graph 300 shows the measured reflection coefficient (also referred to S-parameter or IS11I) 301 of the antenna structure 100 of FIG. 1. The antenna structure 100 covers approximately 700 MHz to 960 MHz in a low band and 1.71 GHz to 2.7 GHz in a high band. The antenna structure 100 provides four resonant modes, including a LB1 303, LB2 305, HB1 307 and HB2 309. LB1 303 is approximately at 700 MHz. LB2 305 is approximately at 1 GHz. HB1 307 is approximately at 1.5 GHz. HB2 309 is approximately at 2.2 GHz. As described herein, other resonant modes may be achieved.

In other embodiments, more or less than three or four resonant modes may be achieved as would be appreciated by one of ordinary skill in the art having the benefit of this disclosure. It should also be noted that the first, second, third, fourth and fifth notations on the resonant modes are not be strictly interpreted to being assigned to a particular frequency, frequency range, or elements of the antenna structure. Rather, the first, second, third, fourth and fifth notations are used for ease of description. However, in some instances, the first, second, third fourth and fifth are used to designate the order from lowest to highest frequencies. Alternatively, other orders may be achieved as would be appreciated by one of ordinary skill in the art having the benefit of this disclosure. In one embodiment, the antenna structure 100 can be configured for the LTE (700/2600), UMTS, GSM (850, 800, 1800 and 1900), GPS and Wi-Fi/Bluetooth frequency bands. In effect, the antenna structure 100 has frequencies between 700 MHz to 2.7 GHz. Conventional multiband antennas for mobile devices usually have a narrow bandwidth and can only cover 824 MHz to 960 MHz and 1710 MHz to 2170 MHz. Using the embodiments described herein with the antenna structure, low impedance variation is feasible over 700 MHz to 2.7 GHz frequency range. Hence, the embodiments described herein can be utilized in any application in the frequency range, like LTE (700/2600), UMTS, GSM (850, 900, 1800 and 1900), GPS and WI-FI/Bluetooth. In another embodiment, the antenna structure 100 can be designed to operate in the following target bands: 1) Verizon LTE band: 746 to 787 MHz; 2) US GSM 850: 824 to 894 MHz; 3) GSM900: 880 to 960 MHz; 4) GSM 1800/DCS: 1.71 to 1.88 GHz; 5) US1900/PCS (band 2): 1.85 to 1.99 GHz; and 6) WCDMA band I (band 1): 1.92 to 2.17 GHz. These resonance bandwidths may be characterized by VNA measurements with about 6 dB bandwidth (BW). Alternatively, the antenna structure 100 can be designed to operate in different combinations of frequency bands as would be appreciated by one of ordinary skill in the art having the benefit of this disclosure. Alternatively, the antenna structure 100 can be configured to be tuned to other frequency bands as would be appreciated by one of ordinary skill in the art having the benefit of this disclosure.

Figure 4:
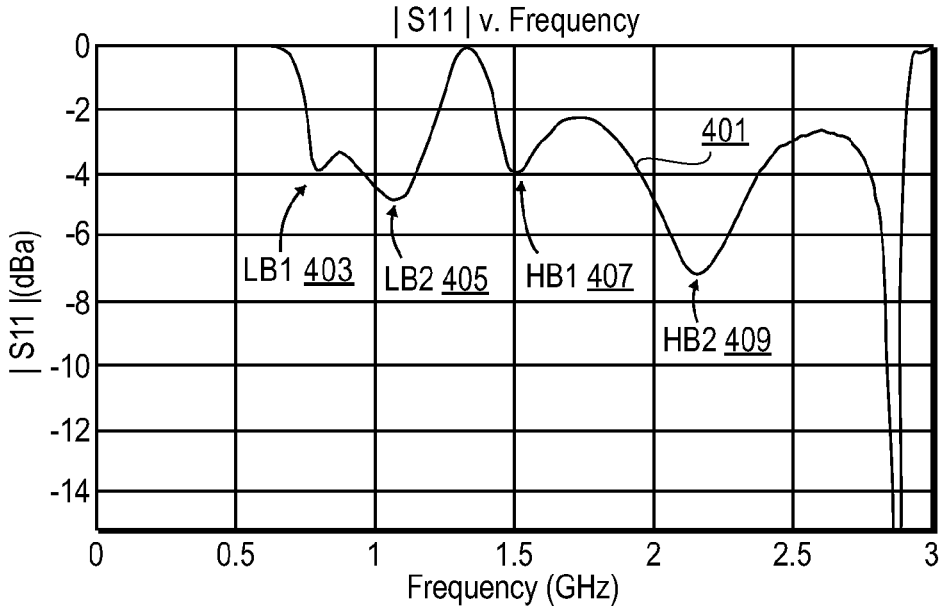
FIG. 4 is a graph of measured reflection coefficient of the antenna structure of FIG. 2 according to one embodiment.

FIG. 4 is a graph 400 of measured reflection coefficient of the antenna structure 200 of FIG. 2 according to one embodiment. The graph 400 shows the measured reflection coefficient (also referred to S-parameter or IS11I) 401 of the antenna structure 200 of FIG. 2. The antenna structure 200 covers approximately 700 MHz to 960 MHz in a low band and 1.71 GHz to 2.7 GHz in a high band. The antenna structure 200 provides four resonant modes, including a LB1 403, LB2 405, HB1 407 and HB2 409. LB1 403 is approximately at 700 MHz. LB2 405 is approximately at 1 GHz. HB1 407 is approximately at 1.5 GHz. HB2 409 is approximately at 2.2 GHz. As described herein, other resonant modes may be achieved. As shown in FIG. 4, the antenna structure 200 has a greater measured reflection coefficient for LB2 405, as compared to LB2 305 of the antenna structure 100.

Figure 5:
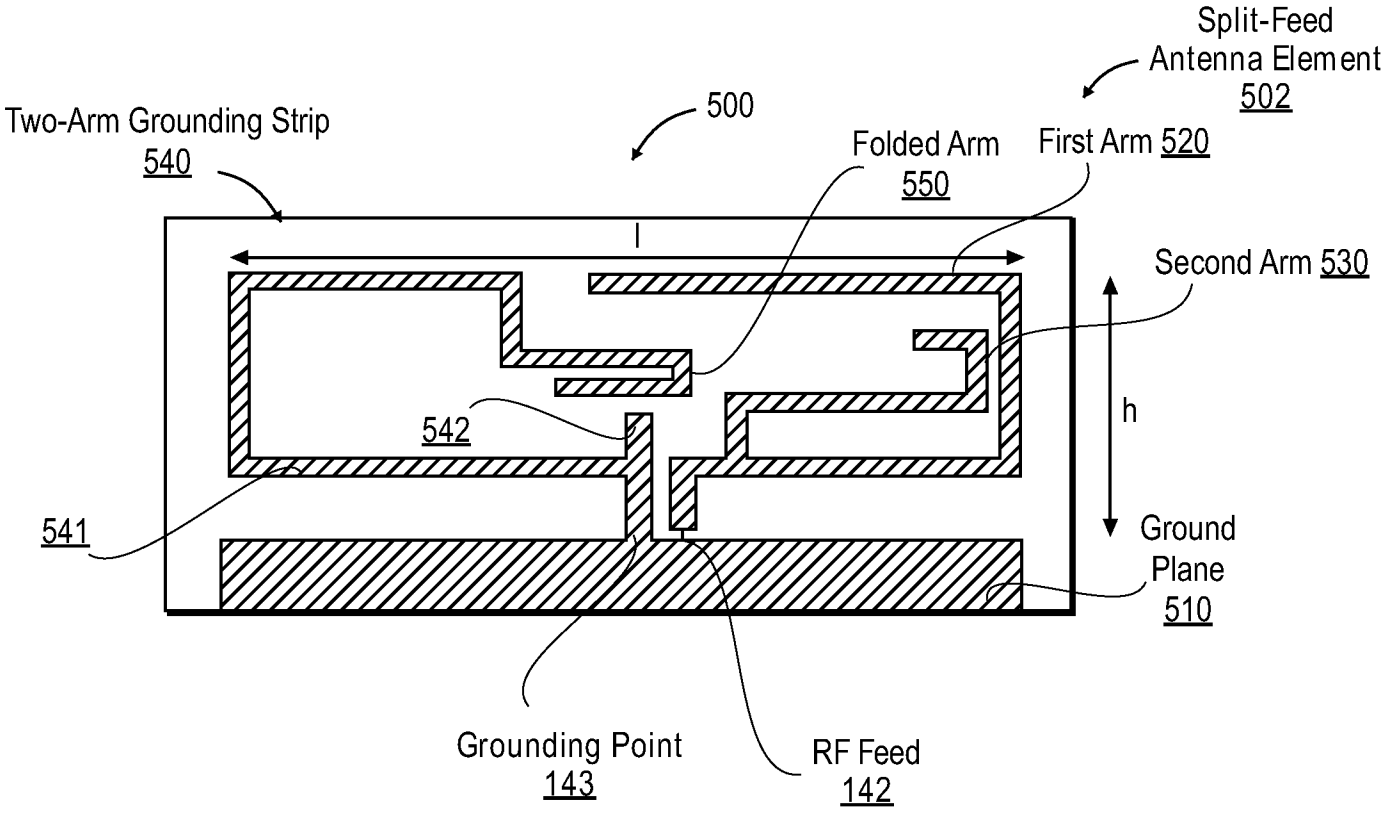
FIG. 5 illustrates one embodiment of an antenna structure including a split-feed antenna element and a parasitic grounding element.

FIG. 5 illustrates one embodiment of an antenna structure 500 including a split-feed antenna element 502 and a parasitic grounding element. The parasitic grounding element is a two-arm grounding strip 540 coupled to a ground plane 510 at a grounding point 143. The split-feed antenna element 502 includes a first folded arm 520 and a second folded arm 530. The second folded arm 530 is disposed within an area defined by at least a portion of the first folded arm. It can be said the second folded arm 530 is disposed within an inner perimeter of the first folded arm 520. In other words, the second arm 530 is not located within the first folded arm 520, and the first folded arm 520 is disposed at least partially around the second folded arm 530. The split-feed antenna element 502 is configured to operate as a feeding structure to the two-arm grounding strip 540 that is not conductively connected to the RF feed 142. It should be noted that the RF feed 142 does not connect to the ground plane 510, rather the RF feed 142 is electrically isolated from the ground plane 510. For example, if the ground plane 510 is the ground plane of a circuit board, the ground plan 510 may be on the back side of the circuit board and the RF feed 142 can be on the top side of the circuit board.

In the depicted embodiment, the first folded arm 520 includes a first section that extends from the RF feed 142 in a first direction until a first bend, extends in a second direction until a second bend, extends in a third direction until a third bend and extends in a fourth direction. The second folded arm 530 extends out from the first folded arm 520 between the first and second bends until a fourth bend, extends in the same second direction as the first folded arm 520 until a fifth bend, and extends in the same third direction as the first folded arm 520 until a sixth bend and extends in the same fourth direction as the first folded arm 520.

In the depicted embodiment, the two-arm grounding strip 540 includes a third arm 542 and a fourth folded arm 541. The third arm 542 extends out perpendicularly from the ground plane 510 in the same first direction as the first folded arm 520. The fourth folded arm 541 extends out from the third arm 542 in an opposite direction as the second direction until a seventh bend, extends in the same third direction as the first folded arm 520 until an eighth bend, extends in the opposite direction as the fourth direction until a ninth bend, extends in the opposite direction as the first direction until a tenth bend, and extends in the same second direction as the first folded arm 520. In a further embodiment, the antenna structure 500 includes a fifth folded arm 550 coupled to a distal end of the two-arm grounding strip 520. It should be noted that the fifth folded arm 550 is also referred to the third folded arm in some cases when referring to the two-arm grounding strip 540 in general. The fifth folded arm 550 extends in the opposite direction as the first direction until an eleventh bend and extends in the same fourth direction as the first folded arm 520.

The antenna structure 500 may be disposed on an antenna carrier (not illustrated). The antenna structure 500 is illustrated as being 2D; however, the antenna structure 500 may be a 3D structure as well. For example, portion of the antenna structure 500 may be wrapped over multiple sides of an antenna carrier. Alternatively, the antenna structure 500 may be disposed on other components of the user device or within the user device as would be appreciated by one of ordinary skill in the art having the benefit of this disclosure.

The antenna structure 500 is configured to provide multiple resonant modes and operate in similar frequency bands as the antenna structure 200. The antenna structure 500 may provide a first low-band mode, a second low-band mode, a first high-band mode and a second high-band mode.

In one embodiment, a height of the antenna structure 500 is between 15 mm and 20 mm and a length of the antenna structure 500 is between 40 mm and 60 mm. The dimensions of the antenna structure 500 may be varied to achieve the desired frequency range as would be appreciated by one of ordinary skill in the art having the benefit of this disclosure. Also, as described herein, portions of the antenna structure can be wrapped around an antenna carrier so that the antenna structure is 3D, which may reduce the height, length, or any combination thereof.

Figure 6:
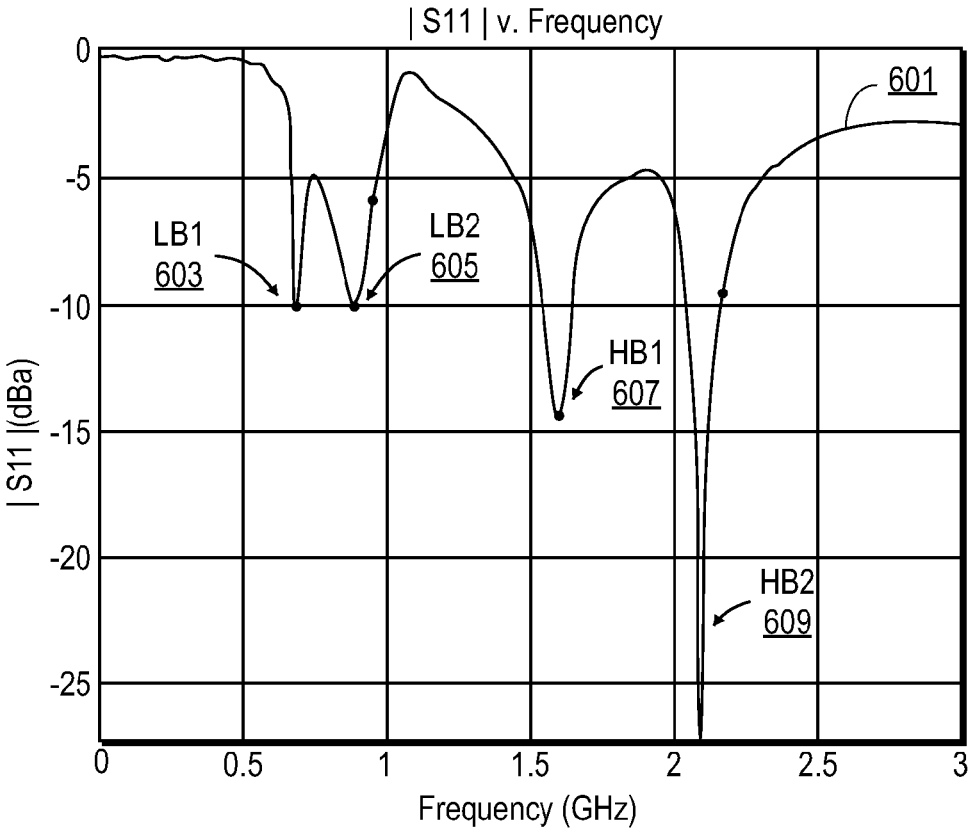
FIG. 6 is a graph of measured reflection coefficient of the antenna structure of FIG. 5 according to one embodiment.

FIG. 6 is a graph 600 of measured reflection coefficient of the antenna structure 500 of FIG. 5 according to one embodiment. The graph 600 shows the measured reflection coefficient (also referred to S-parameter or IS11I) 601 of the antenna structure 500 of FIG. 5. The antenna structure 500 covers approximately 700 MHz to 960 MHz in a low band and 1.71 GHz to 2.17 GHz in a high band. The antenna structure 500 provides four resonant modes, including a LB1 603, LB2 605, HB1 607 and HB2 609. LB1 603 is approximately at 700 MHz. LB2 605 is approximately at 850 MHz. HB1 607 is approximately at 1.6 GHz. HB2 609 is approximately at 2.1 GHz. As described herein, other resonant modes may be achieved. As shown in FIG. 6, the antenna structure 500 has a greater measured reflection coefficient for LB2 605, as compared to LB2 305 of the antenna structure 100. Also, HB2 609 is a lower frequency than HB2 309 and HB 409 of the antenna structures 100 and 200, respectively.

Figure 7:
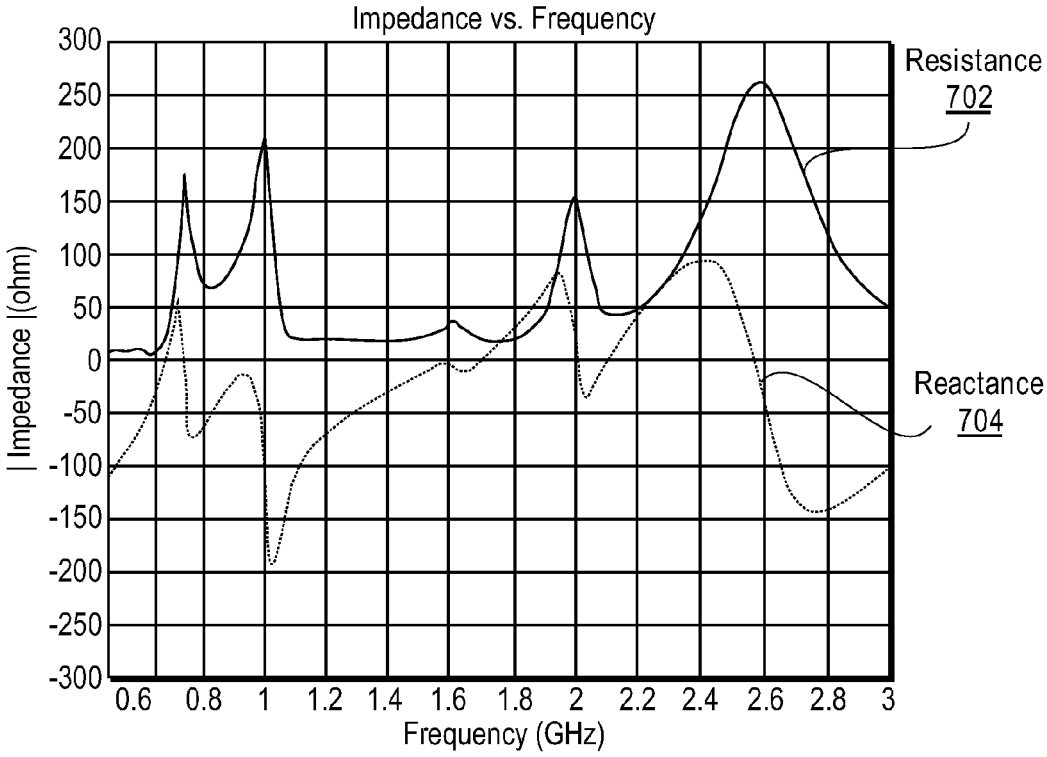
FIG. 7 is a graph of an impedance profile of the antenna structure of FIG. 5 according to one embodiment.

FIG. 7 is a graph 700 of an impedance profile of the antenna structure 500 of FIG. 5 according to one embodiment. The graph 700 illustrates resistance 702 and reactance 704 over a range of frequency of the antenna structure 500. The graph 700 illustrates that the antenna structure 500 is a viable antenna for the frequency range in a low-band between 700 MHz and 960 MHz, and in a high-band between 1.7 GHz and 2.2 GHz.

As would be appreciated by one of ordinary skill in the art having the benefit of this disclosure, the total efficiency of the antenna can be measured by including the loss of the structure and mismatch loss. The efficiency of the antenna can be tuned for specified target bands. For example, the target band can be Verizon LTE band and the GSM850/900 band, and the antenna structure 100 can be tuned to optimize the efficiency for this band as well as for other bands, such as DCS, PCS and WCDMA bands. The efficiency of the antenna structure may be optimized by adjusting dimensions of the 2D structure, the gaps between the elements of the structure, a distance between the RF feed 142 and the grounding points at the ground plane 243, or any combination thereof. Similarly, 3D structures can be modified in dimensions and gaps between elements to improve the efficiency in certain frequency bands as would be appreciated by one of ordinary skill in the art having the benefit of this disclosure. It should also be noted that the antennas described herein may be implemented with two-dimensional geometries, as well as three-dimensional geometries as described herein.

Figure 8:
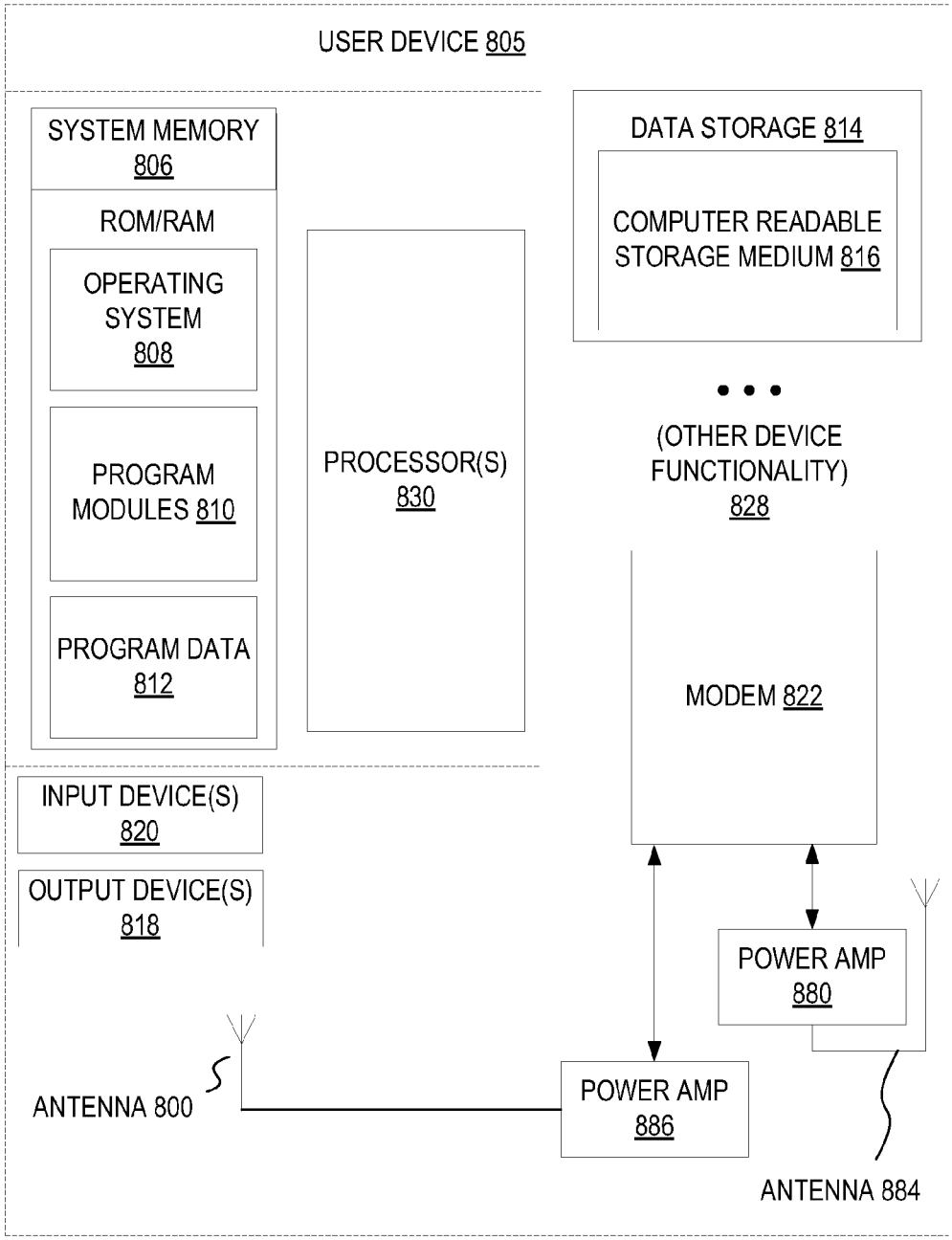
FIG. 8 is a block diagram of a user device having one of the antenna structures described herein according to one embodiment.

FIG. 8 is a block diagram of a user device having an antenna 800 according to one embodiment. The antenna 800 may have one of the antenna structures described herein, such as the antenna structure 100, antenna structure 200, or antenna structure 500. The user device 805 includes one or more processors 830, such as one or more CPUs, microcontrollers, field programmable gate arrays, or other types of processing devices. The user device 805 also includes system memory 806, which may correspond to any combination of volatile and/or non-volatile storage mechanisms. The system memory 806 stores information, which provides an operating system component 808, various program modules 810, program data 812, and/or other components. The user device 805 performs functions by using the processor(s) 830 to execute instructions provided by the system memory 806.

The user device 805 also includes a data storage device 814 that may be composed of one or more types of removable storage and/or one or more types of non-removable storage. The data storage device 814 includes a computer-readable storage medium 816 on which is stored one or more sets of instructions embodying any one or more of the functions of the user device 805, as described herein. As shown, instructions may reside, completely or at least partially, within the computer readable storage medium 816, system memory 806 and/or within the processor(s) 830 during execution thereof by the user device 805, the system memory 806 and the processor(s) 830 constituting computer-readable media. The user device 805 may also include one or more input devices 820 (keyboard, mouse device, specialized selection keys, etc.) and one or more output devices 818 (displays, printers, audio output mechanisms, etc.).

The user device 805 further includes a wireless modem 822 to allow the user device 805 to communicate via a wireless network (e.g., such as provided by a wireless communication system) with other computing devices, such as remote computers, an item providing system, and so forth. The wireless modem 822 allows the user device 805 to handle both voice and non-voice communications (such as communications for text messages, multimedia messages, media downloads, web browsing, etc.) with a wireless communication system. The wireless modem 822 may provide network connectivity using any type of digital mobile network technology including, for example, cellular digital packet data (CDPD), general packet radio service (GPRS), enhanced data rates for GSM evolution (EDGE), UMTS, 1 times radio transmission technology (1xRTT), evaluation data optimized (EVDO), high-speed downlink packet access (HSDPA), WiFi, etc. In other embodiments, the wireless modem 822 may communicate according to different communication types (e.g., WCDMA, GSM, LTE, CDMA, WiMax, etc) in different cellular networks. The cellular network architecture may include multiple cells, where each cell includes a base station configured to communicate with user devices within the cell. These cells may communicate with the user devices 805 using the same frequency, different frequencies, same communication type (e.g., WCDMA, GSM, LTE, CDMA, WiMax, etc), or different communication types. Each of the base stations may be connected to a private, a public network, or both, such as the Internet, a local area network (LAN), a public switched telephone network (PSTN), or the like, to allow the user devices 805 to communicate with other devices, such as other user devices, server computing systems, telephone devices, or the like. In addition to wirelessly connecting to a wireless communication system, the user device 805 may also wirelessly connect with other user devices. For example, user device 805 may form a wireless ad hoc (peer-to-peer) network with another user device.

The wireless modem 822 may generate signals and send these signals to power amplifier (amp) 880 or power amp 886 for amplification, after which they are wirelessly transmitted via the antenna 800 or antenna 884, respectively. Although FIG. 8 illustrates power amps 880 and 886, in other embodiments, a transceiver may be used to all the antennas 800 and 884 to transmit and receive. The antenna 884, which is an optional antenna that is separate from the antenna 800, may be any directional, omnidirectional or non-directional antenna in a different frequency band than the frequency bands of the antenna 800. The antenna 884 may also transmit information using different wireless communication protocols than the antenna 800. In addition to sending data, the antenna 800 and the antenna 884 also receive data, which is sent to wireless modem 822 and transferred to processor(s) 830. It should be noted that, in other embodiments, the user device 805 may include more or less components as illustrated in the block diagram of FIG. 8.

In one embodiment, the user device 805 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WiFi hotspot and a connection to a wireless carrier system. In one embodiment, the first wireless connection is associated with a first resonant mode of the antenna 800 that operates at a first frequency band and the second wireless connection is associated with a second resonant mode of the antenna 800 that operates at a second frequency band. In another embodiment, the first wireless connection is associated with the antenna 800 and the second wireless connection is associated with the antenna 884. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a single modem 822 is shown to control transmission to both antennas 800 and 884, the user device 805 may alternatively include multiple wireless modems, each of which is configured to transmit/receive data via a different antenna and/or wireless transmission protocol. In addition, the user device 805, while illustrated with two antennas 800 and 884, may include more or fewer antennas in various embodiments.

The user device 805 delivers and/or receives items, upgrades, and/or other information via the network. For example, the user device 805 may download or receive items from an item providing system. The item providing system receives various requests, instructions and other data from the user device 805 via the network. The item providing system may include one or more machines (e.g., one or more server computer systems, routers, gateways, etc.) that have processing and storage capabilities to provide the above functionality. Communication between the item providing system and the user device 805 may be enabled via any communication infrastructure. One example of such an infrastructure includes a combination of a wide area network (WAN) and wireless infrastructure, which allows a user to use the user device 805 to purchase items and consume items without being tethered to the item providing system via hardwired links. The wireless infrastructure may be provided by one or multiple wireless communications systems, such as one or more wireless communications systems. One of the wireless communication systems may be a wireless fidelity (WiFi) hotspot connected with the network. Another of the wireless communication systems may be a wireless carrier system that can be implemented using various data processing equipment, communication towers, etc. Alternatively, or in addition, the wireless carrier system may rely on satellite technology to exchange information with the user device 805.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 805 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 805 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

Figure 9:
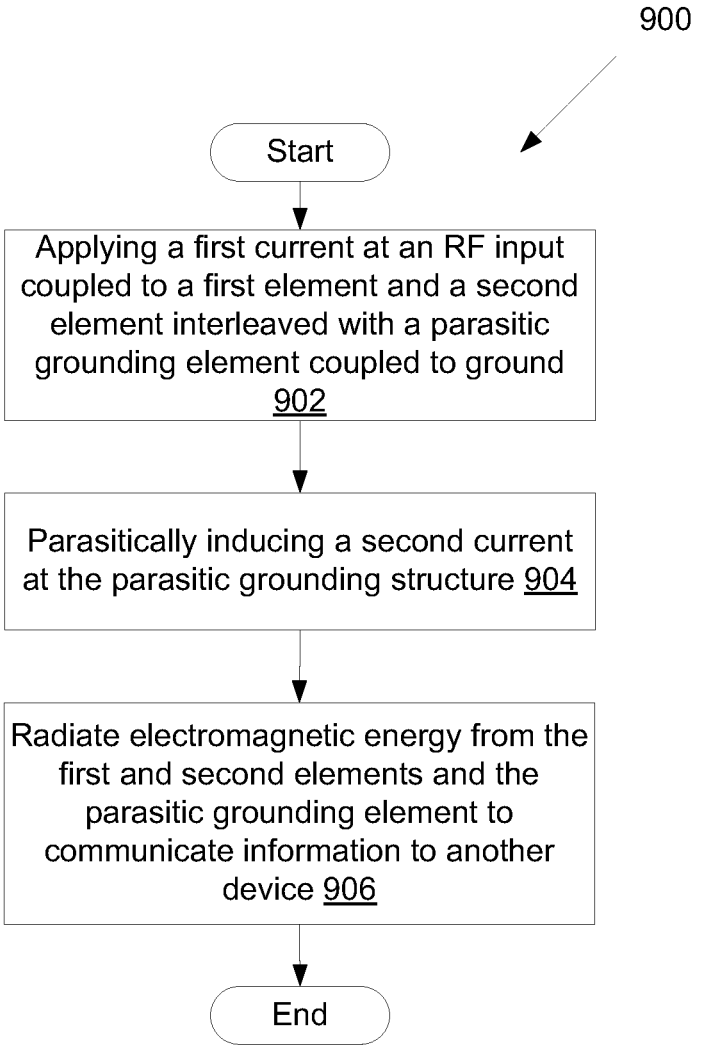
FIG. 9 is a flow diagram of an embodiment of a method of operating a user device having an antenna structure of FIG. 1 according to one embodiment.

FIG. 9 is a flow diagram of an embodiment of a method 900 of operating a user device having an antenna structure 100 of FIG. 1 according to one embodiment. In method 900, a first current is applied at a single radio frequency (RF) input coupled to a first element and a second element of an antenna structure that are interleaved with a parasitic grounding element (block 902). It should be noted that the first current is applied based on the type of RF feed and transmission line are being used. This may be by induction or by conduction as would be appreciated by one of ordinary skill in the art having the benefit of this disclosure. In response, the first and second elements parasitically induce a second current at the parasitic grounding element, the parasitic structure not being conductively connected to the RF feed (block 904). In response to the induced currents, electromagnetic energy is radiated from the first and second elements and the parasitic grounding element to communicate information to another device (block 906). The electromagnetic energy forms a radiation pattern. The radiation pattern may be various shapes as would be appreciated by one of ordinary skill in the art having the benefit of this disclosure.

In another embodiment, a current is applied at the RF feed, which induces a surface current flow of the antenna structure, including a first folded monopole element, a second monopole element, and a two-arm grounding strip. The first folded monopole antenna and the second monopole antenna parasitically induce a current flow of the two-arm grounding strip. By inducing current flow at the two-arm grounding strip, the two-arm grounding strip increases the bandwidth of the antenna structure, providing additional resonant modes to the resonant modes of the first folded monopole element and the second monopole element.

Figure 10:
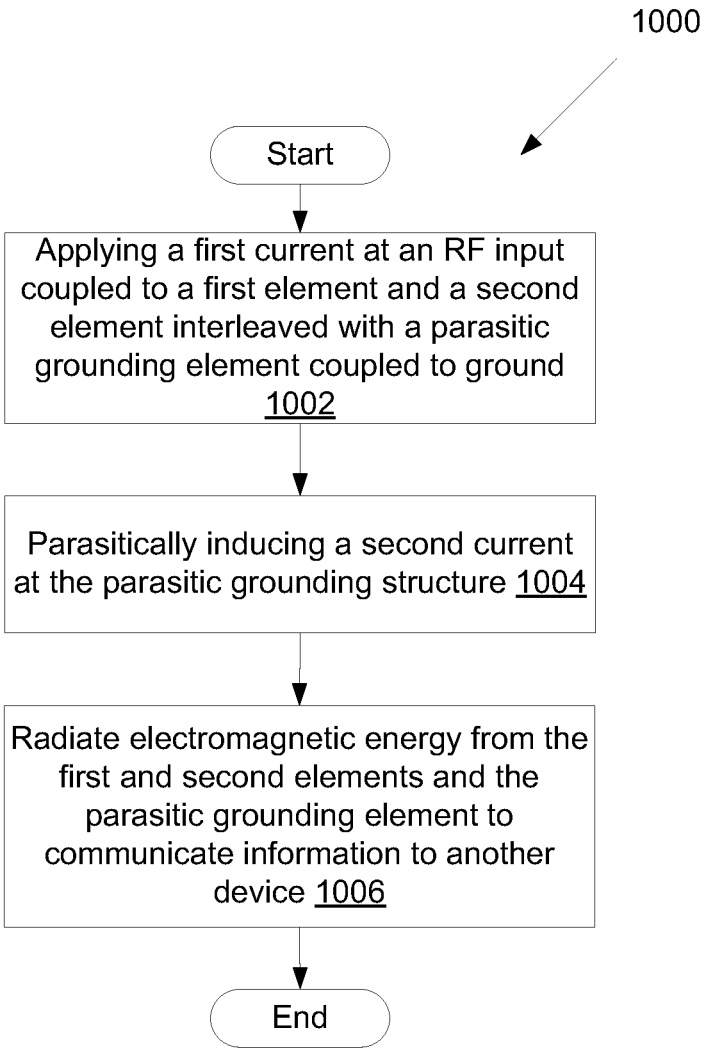
FIG. 10 is a flow diagram of an embodiment of a method of operating a user device having an antenna structure of FIG. 5 according to one embodiment.

FIG. 10 is a flow diagram of an embodiment of a method 1000 of operating a user device having the antenna structure 500 of FIG. 5 according to one embodiment. In method 1000, a first current is applied at a single radio frequency (RF) input coupled to a split-feed antenna element of an antenna structure (block 1002). The antenna structure also includes a parasitic grounding element coupled to a ground plane. In response, the split-feed antenna element parasitically induces a second current at the parasitic grounding element, the parasitic structure not being conductively connected to the RF feed (block 1004). In response to the induced currents, electromagnetic energy is radiated from the split-feed antenna element and the parasitic grounding element to communicate information to another device (block 1006). As above, the electromagnetic energy forms a radiation pattern. The radiation pattern may be various shapes as would be appreciated by one of ordinary skill in the art having the benefit of this disclosure.

In method 900 and method 1000, applying the first current and parasitically inducing the second current provides multiple resonant modes, including a first low-band mode, a second low-band mode, a first high-band mode, and a second high-band mode. In one embodiment of method 900, the first low-band mode and the second low-band mode operate between 700 MHz and 960 MHz, and the first high-band mode and the second high-band mode operate between 1.71 GHz and 2.7 GHz. In one embodiment of method 1000, the first low-band mode and the second low-band mode operate between 700 MHz and 960 MHz, and the first high-band mode and the second high-band mode operate between 1.71 GHz and 2.17 GHz.

In the above description, numerous details are set forth. It will be apparent, however, to one of ordinary skill in the art having the benefit of this disclosure, that embodiments of the present invention may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a selfconsistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "applying," "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments of the present invention also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present invention is not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present invention should, therefore, be determined with reference to the appended claims, along with the full scope of equivalents to which such claims are entitled.

What is claimed is:

1. An electronic device comprising:

a radio frequency (RF) feed;

an antenna structure coupled to the RF feed and a ground plane, wherein the antenna structure comprises:

a split-feed antenna element coupled to the RF feed, wherein the split-feed antenna element comprises a first folded arm and a second folded arm, wherein the second folded arm is disposed within an area defined by at least a portion of the first folded arm;

a two-arm grounding strip coupled to a ground plane, wherein the split-feed antenna element is configured to operate as a feeding structure to the two-arm grounding strip that is not conductively connected to the RF feed; and a third folded arm coupled to a distal end of the two-arm grounding strip.

2. An electronic device comprising:

a radio frequency (RF) feed;

an antenna structure coupled to the RF feed and a ground plane, wherein the antenna structure comprises:

a split-feed antenna element coupled to the RF feed, wherein the split-feed antenna element comprises a first folded arm and a second folded arm, wherein the second folded arm is disposed within an area defined by at least a portion of the first folded arm; and a two-arm grounding strip coupled to a ground plane, wherein the split-feed antenna element is configured to operate as a feeding structure to the two-arm grounding strip that is not conductively connected to the RF feed, wherein the first folded arm comprises a first section that extends from the RF feed in a first direction until a first bend, extends in a second direction until a second bend, extends in a third direction until a third bend and extends in a fourth direction, wherein the second folded arm extends out from the first folded arm between the first and second bends until a fourth bend, extends in the same second direction as the first folded arm until a fifth bend, and extends in the same third direction as the first folded arm until a sixth bend and extends in the same fourth direction as the first folded arm.

3. The electronic device of claim 2, wherein the two-arm grounding strip comprises a third arm and a fourth folded arm, wherein the third arm extends out perpendicularly from the ground plane in the same first direction as the first folded arm, and wherein the fourth folded arm extends out from the third arm in an opposite direction as the second direction until a seventh bend, extends in the same third direction as the first folded arm until an eighth bend, extends in the opposite direction as the fourth direction until a ninth bend, extends in the opposite direction as the first direction until a tenth bend, and extends in the same second direction as the first folded arm.

4. The electronic device of claim 3, further comprising a fifth folded arm coupled to a distal end of the two-arm grounding strip, wherein the fifth folded arm extends in the opposite direction as the first direction until a eleventh bend and extends in the same fourth direction as the first folded arm.

5. An apparatus comprising:

a radio frequency (RF) feed; and an antenna structure comprising:

a split-feed antenna element coupled to the RF feed, wherein the split-feed antenna element comprises a first folded arm and a second folded arm;

a parasitic grounding element coupled to a ground plane, wherein the split-feed antenna element is configured to operate as a feeding structure to the parasitic grounding element that is not conductively connected to the RF feed; and a third folded arm coupled to a distal end of the second folded arm.

6. The apparatus of claim 5, wherein the first folded arm is a first folded monopole and the second folded arm is a second folded monopole, and wherein the parasitic grounding element is a two-arm grounding element comprising a first arm and a second arm.

7. The apparatus of claim 5, further comprising an antenna carrier upon which the antenna structure is disposed.

8. The apparatus of claim 7, wherein the antenna structure is disposed on at least two sides of the antenna carrier.

9. The apparatus of claim 5, wherein a height of the antenna structure is between about 15 millimeters (mm) and about 20 mm and a length of the antenna structure is between about 40 mm and about 60 mm.

10. The apparatus of claim 5, wherein the antenna structure is configured to operate between about 700 MHz and about 960 MHz in a low band and between about 1.71 and about 2.17 GHz in a high band.

11. The apparatus of claim 5, wherein the antenna structure is configured to operate in one or more of the following standard frequency bands: Long Term Evolution (LTE) 700, Universal Mobile Telecommunications System (UMTS), and Global System for Mobile Communications (GSM) 850, GSM 900, GSM 1800, and GSM 1900.

12. The apparatus of claim 5, wherein the antenna structure is configured to provide a plurality of resonant modes.

13. The apparatus of claim 12, wherein the plurality of resonant modes comprises a first low-band mode, a second low-band mode, a first high-band mode, and a second high-band mode.

14. An apparatus comprising:

a radio frequency (RF) feed; and an antenna structure comprising:

a split-feed antenna element coupled to the RF feed, wherein the split-feed antenna element comprises a first folded arm and a second folded arm; and a parasitic grounding element coupled to a ground plane, wherein the split-feed antenna element is configured to operate as a feeding structure to the parasitic grounding element that is not conductively connected to the RF feed, wherein the first folded arm comprises a first section that extends from the RF feed in a first direction until a first bend, extends in a second direction until a second bend, extends in a third direction until a third bend and extends in a fourth direction, and wherein the second folded arm extends out from the first folded arm between the first and second bends until a fourth bend, extends in the same second direction as the first folded arm until a fifth bend, and extends in the same third direction as the first folded arm until a sixth bend and extends in the same fourth direction as the first folded arm.

15. The apparatus of claim 14, wherein the parasitic grounding element is a two-arm grounding element, wherein the two-arm grounding strip comprises a first arm, a second arm, a third arm and a fourth folded arm, wherein the third arm extends out perpendicularly from the ground plane in the same first direction as the first folded arm, and wherein the fourth folded arm extends out from the third arm in an opposite direction as the second direction until a seventh bend, extends in the same third direction as the first folded arm until an eighth bend, extends in the opposite direction as the fourth direction until a ninth bend, extends in the opposite direction as the first direction until a tenth bend, and extends in the same second direction as the first folded arm.

16. The apparatus of claim 15, further comprising a fifth folded arm coupled to a distal end of the two-arm grounding strip, wherein the fifth folded arm extends in the opposite direction as the first direction until a eleventh bend and extends in the same fourth direction as the first folded arm.

17. A method of operating an electronic device, the method comprising:

applying a first current at a radio frequency (RF) input coupled to a split-feed antenna element of an antenna structure, wherein the split-feed antenna element comprises a first arm and a second arm, wherein the antenna structure further comprises a parasitic grounding element coupled to a ground plane and a third arm coupled to a distal end of the parasitic grounding element;

in response to the applying, parasitically inducing a second current at the parasitic grounding element of the antenna structure, wherein the parasitic grounding element is not conductively connected to the RF feed; and radiating electromagnetic energy from the split-feed antenna element and the parasitic grounding element to communicate information to another device in response to the first and second currents.

18. The method of claim 17, wherein said inducing the first current and parasitically inducing the second current collectively provides a plurality of resonant modes.

19. The method of claim 18, wherein the plurality of resonant modes comprises a first low-band mode, a second low-band mode, a first high-band mode, and a second high-band mode, and wherein the first low-band mode and the second low-band mode operate between about 700 MHz and about 960 MHz, and the first high-band mode and the second high-band mode operate between about 1.71 GHz and about 2.17 GHz.

20. A method of operating an electronic device, the method comprising:

applying a first current at a radio frequency (RF) input coupled to a split-feed antenna element of an antenna structure, wherein the split-feed antenna comprises a first arm and a second arm, the first arm comprising a first section that extends from the RF input in a first direction until a first bend, extends in a second direction until a second bend, extends in a third direction until a third bend and extends in a fourth direction, and the second arm extending out from the first arm between the first and second bends until a fourth bend, extending in the same second direction as the first arm until a fifth bend, and extending in the same third direction as the first arm until a sixth bend and extends in the same fourth direction as the first arm, and wherein the antenna structure further comprises a parasitic grounding element coupled to a ground plane;

in response to the applying, parasitically inducing a second current at the parasitic grounding element of the antenna structure, wherein the parasitic grounding element is not conductively connected to the RF input; and radiating electromagnetic energy from the split-feed antenna element and the parasitic grounding element to communicate information to another device in response to the first and second currents.

21. The method of claim 20, wherein said inducing the first current and parasitically inducing the second current collectively provides a plurality of resonant modes, and wherein the plurality of resonant modes comprises a first low-band mode, a second low-band mode, a first high-band mode, and a second high-band mode, and wherein the first low-band mode and the second low-band mode operate between about 700

MHz and about 960 MHz, and the first high-band mode and the second high-band mode operate between about 1.71 GHz and about 2.17 GHz.

* * * * *